United States Patent [19]

Barbieri

[11] 4,400,968

[45] Aug. 30, 1983

[54] APPARATUS FOR REFORMING DEFORMED CONTAINER STRUCTURES AND THE LIKE

[76] Inventor: Louis C. Barbieri, 9407 E. Marginal Way, Seattle, Wash. 98108

[21] Appl. No.: 255,368

[22] Filed: Apr. 20, 1981

[51] Int. Cl.[3] ..... B21J 13/04; B21D 1/12

[52] U.S. Cl. ..... 72/457; 72/705; 72/393; 72/469

[58] Field of Search ..... 72/392, 379, 381, 469, 72/705, 399, 457

[56] References Cited

U.S. PATENT DOCUMENTS

| | | | |
|---|---|---|---|
| Re. 30,914 | 4/1982 | Chisum | 72/457 |
| 2,334,080 | 11/1943 | Freeman | 72/705 |
| 2,442,939 | 6/1948 | Schram | 72/399 |
| 2,944,583 | 7/1960 | Welindt | 72/469 |
| 3,201,968 | 8/1965 | Hill | 72/705 |
| 3,408,848 | 11/1968 | Lague et al. | 72/705 |
| 3,525,249 | 8/1970 | Bellemare | 72/705 |
| 3,776,022 | 12/1973 | Lionello | 72/705 |
| 3,985,014 | 11/1976 | Smith | 72/457 |
| 4,336,705 | 6/1982 | Specktor | 72/705 |

FOREIGN PATENT DOCUMENTS

| | | | |
|---|---|---|---|
| 759362 | 9/1980 | U.S.S.R. | 72/457 |

*Primary Examiner*—Lowell A. Larson

*Attorney, Agent, or Firm*—Delbert J. Barnard

[57] ABSTRACT

Large containers for moving cargo are frequently made of steel in which the side panels are strengthened by making them so as to have elongated alternate lands and grooves. The invention is an apparatus for reforming deformed lands and grooves and removing dents in the panels. It includes a power actuated tool for applying force against the deformed structure and a hydraulic power source connected to the tool. A four-way valve is used to supply pressurized fluid from the source to the tool. A frame connected to the hydraulic power source extends externally of the tool, of a tool holding stand, and of the deformed structure. On each side of the panels the frame has vertical members having protrusions which are adapted to move into spaced grooves formed on the outside of the panels and adjacent the deformation on one side of the container. On the other side of the container the protrusions fit in spaced grooves which have inner surfaces forming internal lands within the container on which a backing plate of the tool exerts a force when the tool acts to straighten a deformed groove or other surface.

11 Claims, 10 Drawing Figures

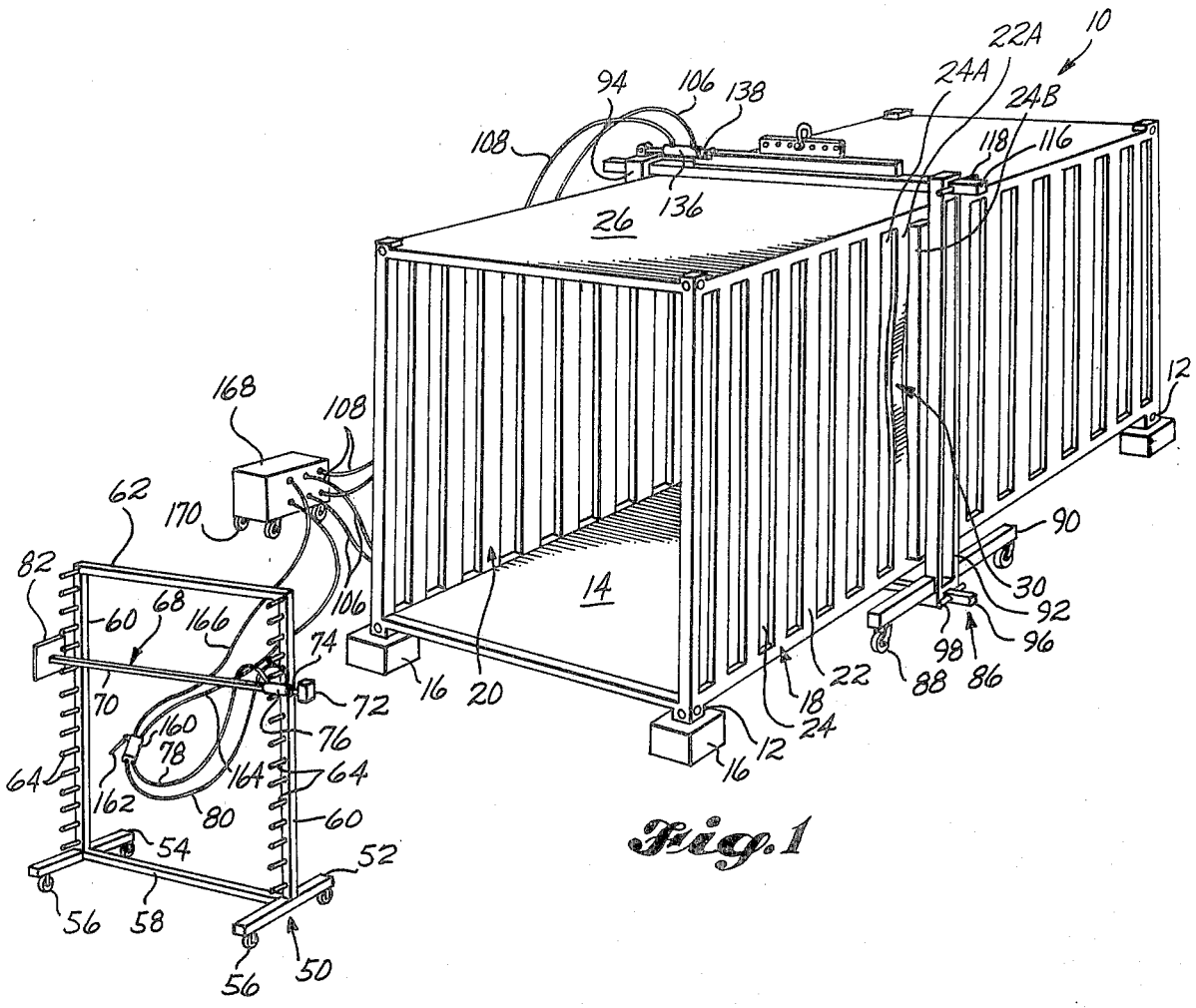
Fig. 1
Fig. 3
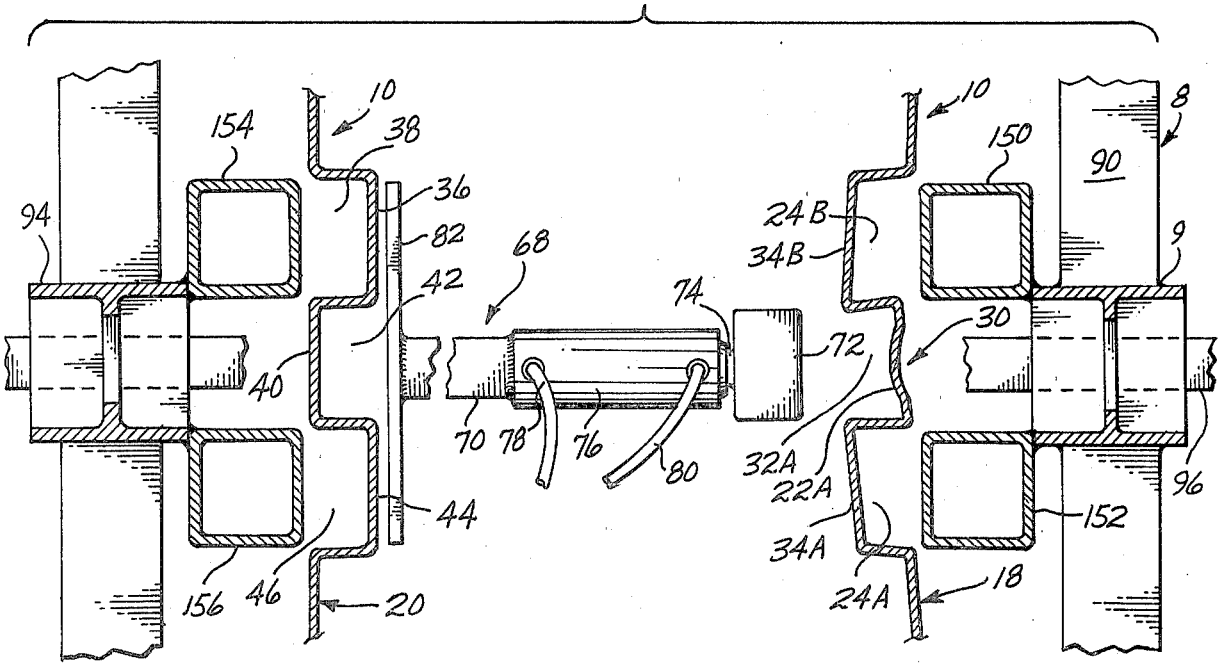

APPARATUS FOR REFORMING DEFORMED CONTAINER STRUCTURES AND THE LIKE

BACKGROUND OF THE INVENTION

The invention relates to apparatus for reforming deformed structures, and more particularly to apparatus for reforming and removing dents from large cargo containers which are made of steel panels, strengthened with alternate vertical lands and grooves.

Containerized cargo movement is relatively new and it involves the use of large containers which are modular structural units on a pallet-style base. In use, the cargo is packed into a container which is typically sealed. It is then transported by truck, railroad flat car, ship or a combination of the foregoing. For example, the container may initially be secured to the bed of a truck or trailer so as to provide a van-like vehicle. The truck may be used for carrying such containers to a railroad and there removed and secured to a flat car, or may be carried to a dock where the containers are removed and loaded as cargo on a ship. At the destination of the train or ship the containers once again may be placed upon trucks and carried to the destination of the cargo.

The containers are lifted, loaded and unloaded by various types of hoisting mechanisms and loading equipment. When being so lifted, loaded, and unloaded, and sometimes during travel, the containers may be damaged. They are usually are of the type having steel side walls strengthened by being formed of alternate lands and grooves. Side wall denting is the most common type of damage and it is the repair of this type of damage to which the present invention is applied.

Prior to my invention it was the practice to pound out the dents with hammers. Usually a crew of repairmen work together pounding out the deformation with hammers until the deformed region of a side wall is approximately reformed. One disadvantage of this method of repair is that the straightened region is unattractive because of the marks left by the hammers. A second disadvantage is that hammers work the metal so as to make it easier to be dented and if dented again, make it more susceptible to cracking.

SUMMARY OF THE INVENTION

The present invention provides an improved apparatus for removing dents from metal sheets or panels. It is particularly adapted for reforming damaged panels of large modular cargo containers which are typically strengthened by being formed with alternate lands and grooves, the latter extending generally vertically from the bottom of the containers to the top.

For reforming generally parallel container panels, the invention includes a tool having a ram at one end and a backing plate at the other end to be positioned between the panels. The apparatus also provides supports for the exterior of the panels in the area where the tool is operating. Dents typically form recesses extending inwardly from the outer surfaces. The reforming operation is thus one of usually forcing inwardly dented surfaces outwardly to a position where they are relatively straight. The outer support members of the apparatus are fluid powered to exert inwardly directed force against the panels at the same time the ram forces the dented region outwardly, and thereby panels are restrained from moving outwardly farther than the straightened or vertical positions at which planes the denting has been removed.

Accordingly, it is an object of the invention to provide an improved power tool for removing deformations from metal panels or sheets and which has means for restraining the tool from working beyond the planes of the normal configuration. The power tool can thus act with great force, as needed, but is restrained from forcing the metal being repaired beyond the desired planar limits.

Further objects and advantages of invention may be brought out in the following part of the specification wherein small details have been described for the competence of the disclosure, without intending to limit the scope of the invention which is set forth in the appended claims.

BRIEF DESCRIPTION OF THE DRAWINGS

Referring to the accompanying drawings which are for illustrative purposes.

FIG. 1 is a perspective, partially exploded view of the invention, illustrating its use on a cargo container having side panels formed of alternate lands and grooves;

FIG. 3 is a fragmentary plan view of the invention and damaged container, taken along the lines 3—3 in FIG. 2;

DESCRIPTION OF THE PREFERRED EMBODIMENTS

Figure 2:
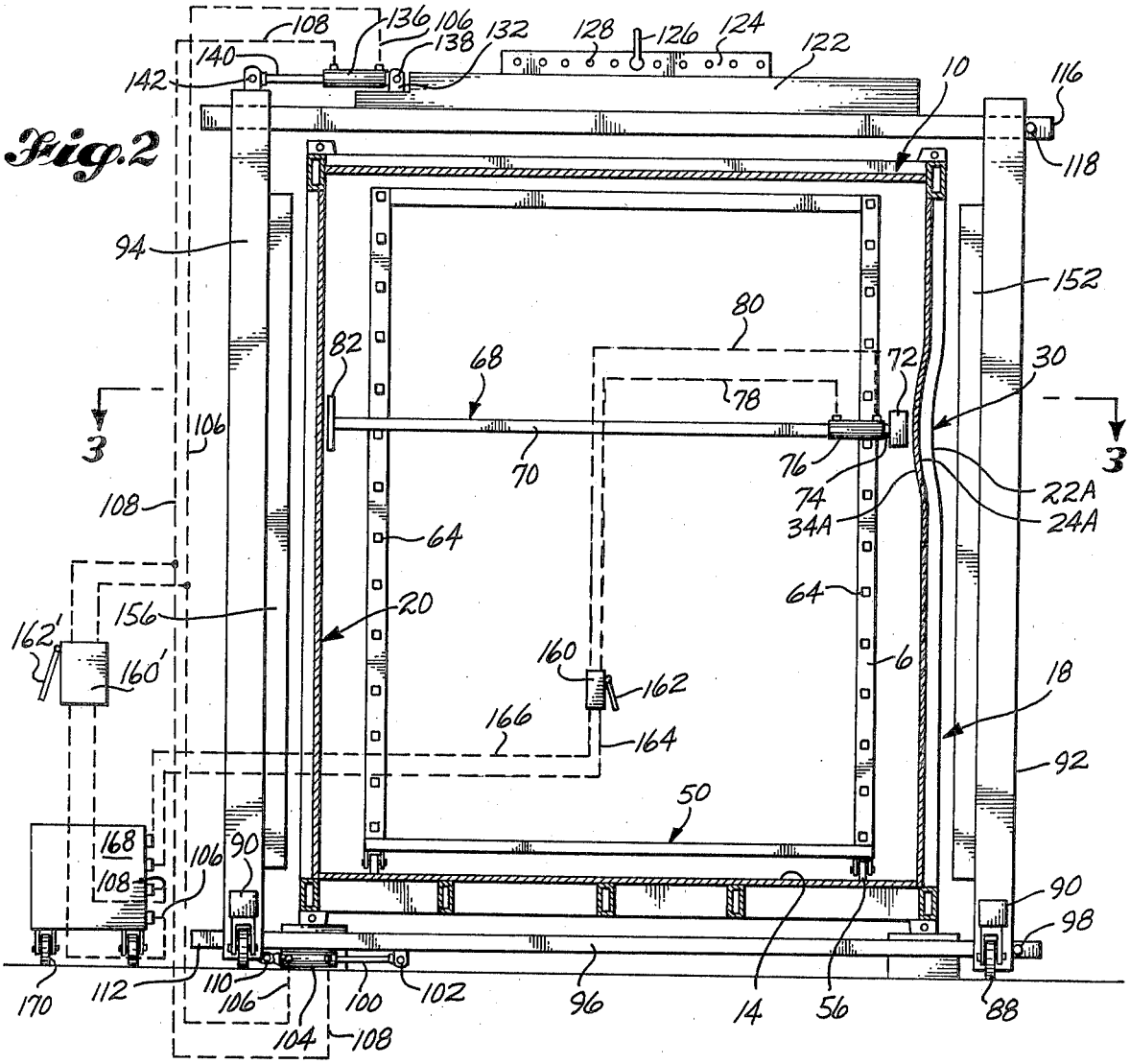
FIG. 2 is an end view of the apparatus, according to the invention, in position to repair a damaged container shown in cross section.

Referring again to the drawings, there is shown in FIG. 1 a large modular cargo container, generally designated as 10. The container is of the pallet-type, having legs 12 so that the bottom 14 is normally raised from the surface on which the container rests. In FIG. 1 the container is raised additionally by the insertion of blocks 16 under the legs. Such containers are generally made of steel and have side panels, as 18 and 20, formed of alternate lands and grooves 22 and 24, respectively. The panels are so formed for strengthening, and the lands and grooves extend substantially for the entire vertical extent of the panels. The container has a closed top 26, and when loaded, both ends are normally closed.

Here the container is shown to have been inwardly dented, to form a generally concave recess, designated as 30. A principal part of the dent is in the land 22A, FIGS. 2 and 3. Part of the damage extends into the metal forming the grooves 24A and 24B on the sides of the land 22A. Inwardly of the damaged land is channel-shaped groove 32A, land 22A forming the base of the channel. Grooves 24A and 24B have channel bottoms which form inner lands 34A and 34B.

As best seen in FIG. 3, directly opposite the damaged area 30 in the panel 20, there are interior land 36 of exterior groove 38, exterior land 40 of interior groove 42, and interior land 44 and exterior groove 46.

In FIG. 1 there is a tool support and guide, generally designated as 50, having base members 52 and 54 supported on rollers 56. Members 52 and 54 are spaced by horizontal support member 58, and at each end thereof is a vertical member 60, the upper ends of the members 60 being joined by a cross bar 62. Extending from the members 60 are a multiple number of horizontal tool support and guide pins 64 arranged to support a tool, generally designated as 68, in a multiple number of horizontal positions over the height of the panels 18 and 20. For operation the tool support 50 is positioned on the bottom 14 of the container 10, as best seen in FIG. 2.

The tool 68 is comprised of an elongated bar 70 having a generally rectangularly prism-shaped hydraulic ram 72 at one end on a piston rod 74 extending from a hydraulic cylinder 76. The cylinder 76 has a piston, not shown, on the end of the rod 74 and the piston moves between the hydraulic openings connected to hoses 78 and 80 according to the direction of hydraulic fluid flow. At the other end of the tool 68 is a rectangular backing plate 82 for pressure engagement with a supporting surface when the tool is actuated.

Figure 5:
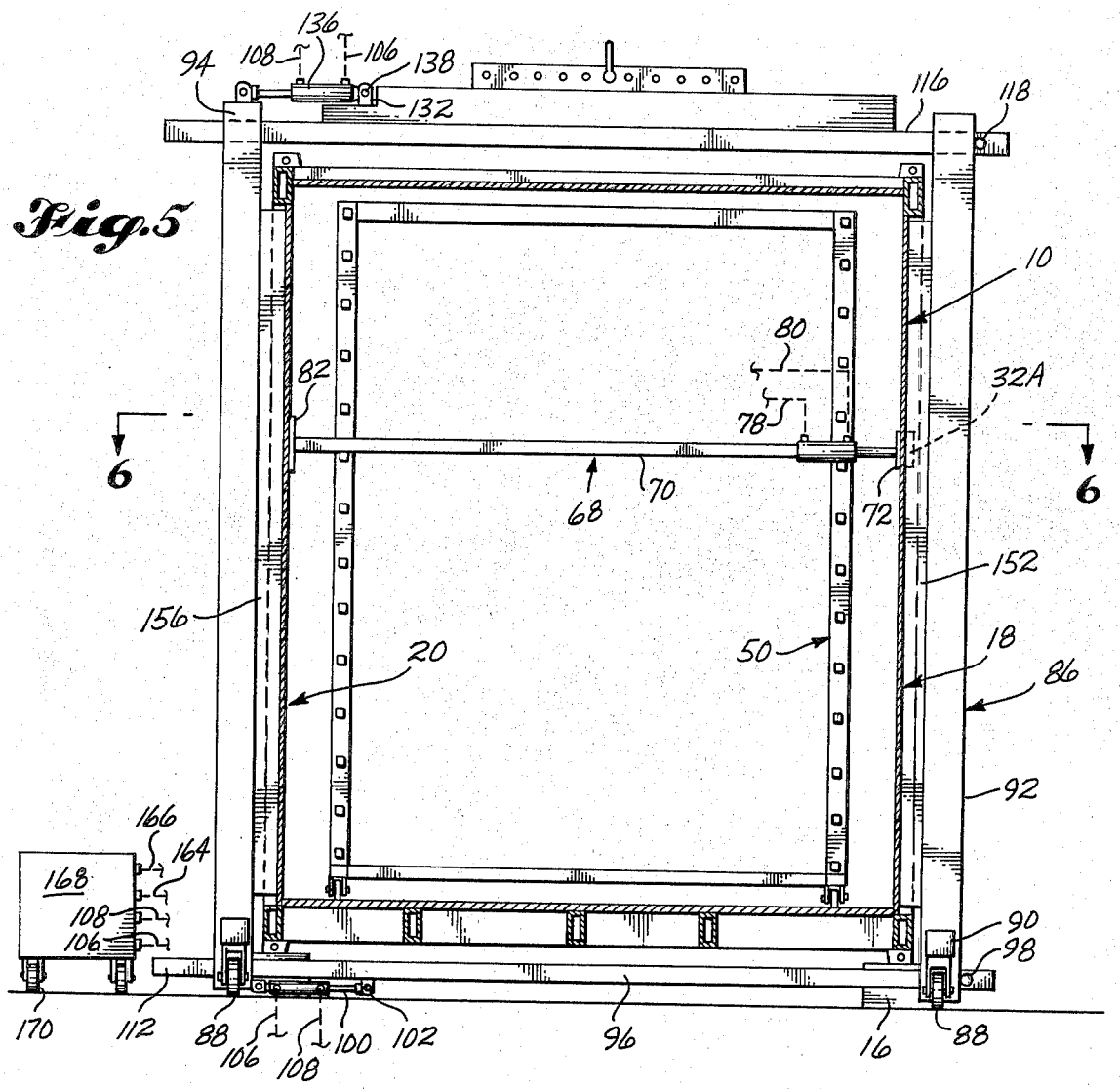
FIG. 5 is an end view similar to FIG. 2, illustrating the invention in position after the denting has been removed from the container.

In FIGS. 1, 2 and 5, the tool 68 is shown supported on two pins 64 to position it at the proper height for moving against a dented portion. The support 50 is rolled on surface 14 to position the tool horizontally and during the operation the tool is raised and lowered on the pins 64 as necessary to reform the panel structure.

As best seen in FIGS. 1, 2 and 5, extending around the container 10, the dented area 30, the tool 68, and the tool support 50 is a generally rectangular frame, designated as 86. The frame is supported on four rollers 88 for horizontal movement. The rollers are fitted into horizontal support members 90 on opposite lower ends of the frame. Fixed to one of the supports 90 on one side of the frame is a vertical I-beam 92 and fixed to the support 90 on the other side is a similar vertical I-beam 94. Slidably engaged in the lower ends of the I-beams is a bar 96. Bar 96 has a horizontal pin 98 extending through one end, the pin being adapted to cause the I-beam 92 to move to the left when the bar 96 is moved to the left, as indicated in FIG. 2.

Adjacent the other end of the bar 96 a piston rod 100 is pivotally mounted thereto at 102. The rod 100 extends into a hydraulic cylinder 104 and has a piston on its end, not shown, within the cylinder, being positioned between the hydraulic fluid lines 106 and 108. The cylinder 104 is pivotally secured at 110 to the bottom of the I-beam 94. The end 112 of the bar 96 extends beyond the I-beam 94 and is limited in its movement with respect to the beam by the cylinder and piston arrangement.

Slidably engaged in the upper ends of the I-beams 92 and 94 is a horizontal cross bar 116, FIG. 2. Like the pin 97 in the lower bar, a pin 118 extends through the bar 116 to cause the I-beam 92 to move to the left with the bar 116. Fixed to the top of the bar 116 is a horizontal strengthening member 122 and secured thereto is a lifting rail 124, having an eye 126 engaged in one of the openings 128, the eye being positioned for attachment to a device for lifting the entire frame 86. Adjacent the left end of the member 122 is a pivot support 132 to which hydraulic cylinder 136 is pivotally mounted at 138. A piston, not shown, is slidably engaged within the cylinder 136 between the hydraulic lines 106 and 108 and is secured to a piston rod 140, extending outwardly of the cylinder and being pivotally engaged with the top of the I-beam 94 at 142.

Figure 4:
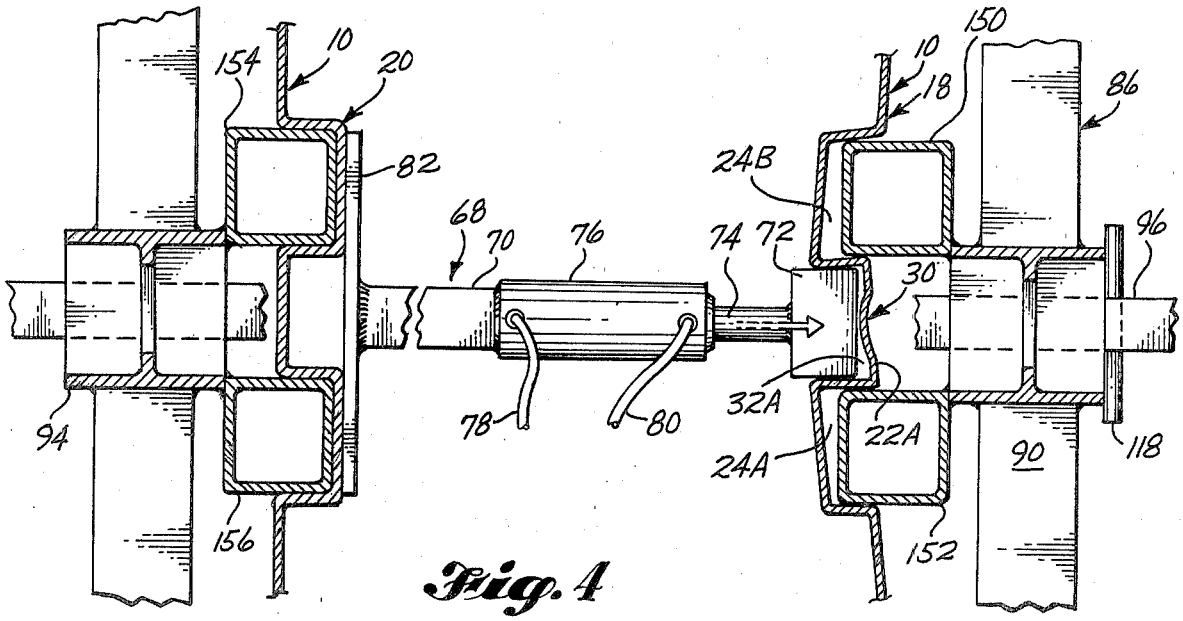
FIG. 4 is a plan view similar to FIG. 3 but illustrating the operation of the invention removing denting from the damaged container.
Figure 6:
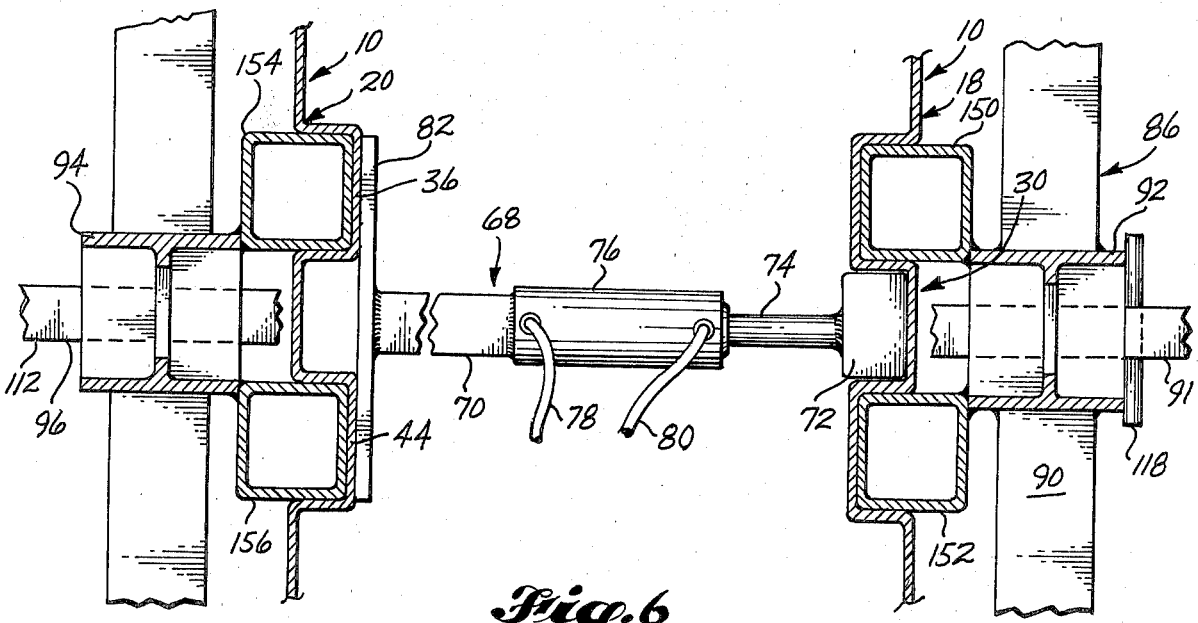
FIG. 6 is a fragmentary partially cross-sectional plan view, taken along the lines 6—6 in FIG. 5.
Figure 7:
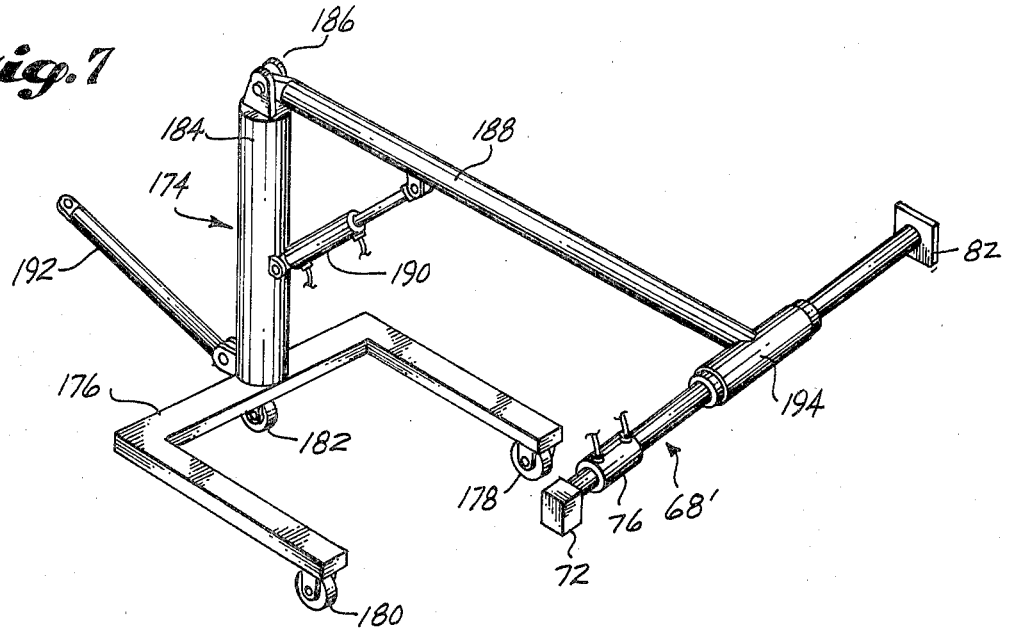
FIG. 7 is a perspective view of a modified form of tool support and guide which utilizes hydraulic power for lifting and placing the tool.
Figure 8:
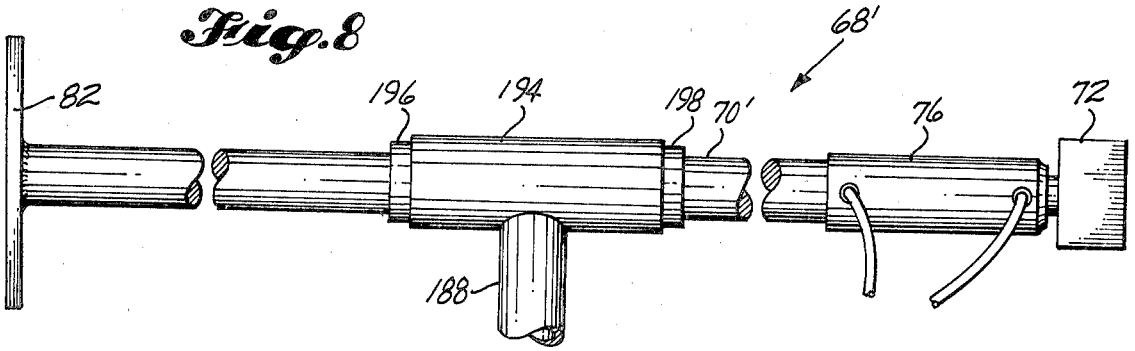
FIG. 8 is a fragmentary plan view of the tool, showing the manner that it is supported at the outer end of the support boom portion of the mechanism shown by FIG. 7.

As shown in FIGS. 2 and 3, vertically extending tubular members 150 and 152 protrude horizontally inwardly from vertical frame member 92. Similarly, vertically extending tubular members 154 and 156 protrude inwardly from vertical frame member 94. The protrusions 150, 152, 154, and 156 are rectangular and in cross section each side thereof, FIGS. 3 and 4, has the width of a panel groove, such as 24 and 38. Each pair of each side of the frame are spaced apart the width of a land, such as the 22 and 40. The protrusions 152 and 156, FIG. 5, as well as the protrusions 150 and 154, not shown, extend substantially for the full length of the panel grooves, and are fit into the respective grooves when the tool is repairing the damaged area and the backing plate is in a pressure relationship with the inwardly facing lands 36 and 44 and the protrusions 154 and 156, FIG. 6.

As best seen in FIGS. 1 and 2, hydraulic lines 78 and 80 which are connected to cylinder 76 to operate the tool are connected to a four-way hydraulic valve 160 having an operating handle 162. The other end of the valve is connected to hydraulic lines 164 and 166 which are in turn connected to a source of hydraulic fluid pressure in console 168. The console 168 may include any conventional hydraulic pumping system in which pressure is created to cause an external flow therefrom and is adapted to receive return flow. The console 168 is mounted on rollers 170 so that it can be moved along with the frame 86 and the tool support and guide 50.

In FIG. 1, lines 106 and 108 are shown as double lines entering the console but because they are internally joined, they are shown joined externally in FIG. 2 and are shown as single lines.

In operation the inventive apparatus is positioned as shown in FIGS. 2 and 3. The tool is on guide and support pins 64 to be in proper vertical and horizontal alignments so that the ram will engage the dented portions in the most effective locations.

With respect to the area 30 and the adjacent lands and grooves, as 22A, 24A, and 24B, on one side and lands and grooves 36, 44, 38, and 46 on the opposite side, the frame is positioned to have the protrusions 150, 152, 154, and 156 as shown in FIG. 3. To commence the operation, a switch, not shown, in the console 168, FIG. 2, is operated to increase fluid pressure in lines 108 to be greater than that in lines 106. This causes the pistons in cylinders 104 and 136 to be operated to move frame members 92 and 94 inwardly, as in FIG. 4, the protrusions 150, 152, 154 and 156 moving into the respective grooves. The tool 68 is then ready to operate.

Valve 160 is then operated to cause a higher pressure in line 78 than in line 80 to move the ram 72 into groove 32A to restore lands 22A, 34B and 34A, and the surrounding structures to their original configurations, FIGS. 2, 3, 4 and 6. When the ram is operated, the backing plate 82 is forced into a pressure association with land 36 and 44 and with protrusions 154 and 156 to support the operation of the tool, FIGS. 4–6.

Complete restoration is not usually accomplished with one operation of the ram and frequently they are repeated in place after retraction by pressurization of fluid in line 80. The tool, of course, must be realigned both vertically and horizontally on the support 50 as the reformation of the damaged area 30 proceeds and is completed. Horizontal adjustment may also have to be made of the positions of the protrusions 150, 152, 154 and 156. This is accomplished by retracting frame members 92 and 94 by increased pressure in lines 106, FIG. 2, and then after realignment, increasing pressure in lines 108.

Owing to its unique construction, the rectangular frame 86 can be easily dismantled by removing the pin connections at its four corners. The two columns 94 and the upper end lower cross pieces 122, 96, and the tool, can be crated for easy handling and transporting from place-to-place. And, such components can be readily re-assembled at each place of use.

The external lines 106, 108 may include a four-way hydraulic control valve 160' having an operating handle 162'. On the side of this valve 160' distal the console 168 the lines 106, 108 branch out and extend to both the lower cylinder 104 and the upper cylinder 136. Operation of the four-way valve 160' results in the two cylinders 104, 136 operating in unison.

Referring to FIGS. 7–10, the modified form of tool holder 174 includes a frame and boom structure which is per se well known. The frame may include a generally U-shaped base 174 having three support wheels 178, 180, 182. Wheel 182 is a swivel wheel, permitting easy steering of the tool holder 174. A tubular support column 184 projects upwardly from the central rear portion of frame 176 and at its upper end is pivotally connected at 186 to the inner end of an elongated boom 188. A hydraulic cylinder 190 is interconnected angularly between support column 174 and boom 188. Cylinder 190 is preferably equipped with a hand operated pump (not shown) and appropriate valving for causing its extension and retraction. Tool 174 is provided with a handle 192 for use in moving and positioning it, relative to a wall to be reformed.

According to an aspect of the present invention, a support sleeve 194 is attached to the outer end of boom 188. A mid-portion of a tubular tool shaft 70' is loosely housed within sleeve 194 so that the tool 68' can be rotated in position relative to sleeve 194. A pair of collars 196, 198 are secured to shaft 70' at the opposite ends of sleeve 194, to restrain endwise movement of tool 68' relative to sleeve 194. In all other respects the tool 68' may be identical to the tool 68.

Figure 9:
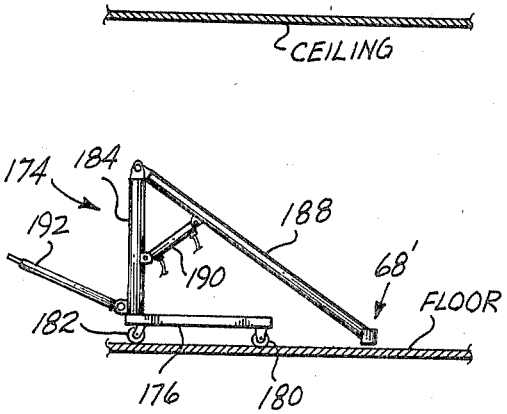
FIG. 9 is a diagramatic elevational view showing the tool position at floor level by the mechanism shown by FIG. 7.
Figure 10:
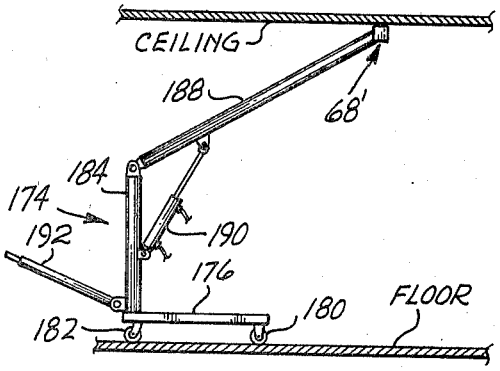
FIG. 10 is a view like FIG. 9, but showing the tool positioned against the ceiling of the container.

An advantage of tool holder 174 is that it can be operated to position the tool 68' down flat on the floor, or up flat against the ceiling, or at any position in between. Also, it does not require manual lifting of the tool 68'. The two extreme positions of the tool are illustrated by FIGS. 9 and 10 of the drawing.

The invention and its attendant advantages will be understood from the foregoing description and it will be apparent that various changes will be made into form, construction and arrangements of the parts of the invention without departing from the spirit and scope thereof or sacrificing its material advantages, the arrangements herein before described being merely by way of example. I do not wish to be restricted to the specific form shown or use as mentioned except as defined in the accompanying claims.

What is claimed is:

1. Apparatus for reforming a container structure having spaced apart sidewalls interconnected by a top and a floor, comprising:

a reaction frame movable relatively along said container, said reaction frame comprising a separate vertical side member positionable outwardly adjacent each side of the container, adjustable connector means interconnecting the vertical side members both above and below the container, said connector means being extendable for moving the vertical side members apart and retractable for moving the vertical side members together, and carriage means supporting the movable frame for movement lengthwise of the container; and an extendable-retractable power ram operable for applying a force, from within the container, against a sidewall portion of the container, said power ram having a forming end and a reaction end, whereby the frame can be moved longitudinally of the container until a first of said vertical side members is positioned immediately outwardly of a deformed sidewall portion of the container, and said adjustable connector means can be retracted for the purpose of bringing said first vertical side member into a backup position adjacent the deformed portion of the sidewall and at the same time bringing the other vertical side member into a bracing position against the opposite sidewall of the container, and the ram can be positioned inside the container in alignment with said vertical side members, with its forming end against the inner side of the deformed portion of the sidewall and its reaction end against the opposite sidewall, and the ram can then be extended to apply a force against the sidewall to tend to remove the deformation therein, and the force of the ram will be reacted into the reaction frame.

2. Apparatus according to claim 1, wherein the adjustable connector means comprises a top cross tie member and a bottom cross tie member, each cross tie member being secured at one of its ends to one of the vertical members and at its opposite end being movable relative to the other vertical member, and wherein a double acting hydraulic cylinder is interconnected between each cross tie member and said other vertical member for providing the adjustment.

3. Apparatus according to claim 1, comprising support means for the extendable-retractable power ram, said support means being supportable on the floor of said container, for movement longitudinally of the container, said support means including means for adjustably supporting the extendable-retractable power ram vertically.

4. Apparatus according to claim 1, usable for reforming a container having corrogated sidewalls comprising alternate lands and grooves, wherein said first vertical member carries a pair of spaced apart forming members sized to fit into two adjacent outside grooves, and wherein the forming end of the power ram is adapted to be moved into and fit within an inside groove between two adjacent inside lands.

5. Apparatus according to claim 4, wherein the reaction end of the ram comprises a member which spans across an inside groove and contacts two inside lands on opposite sides of said inside groove.

6. Apparatus according to claim 4, wherein each said vertical side member comprises a vertical beam member and said spaced apart forming members are lengths of rectangular tubing secured to said beam member and projecting laterally inwardly therefrom.

7. Apparatus according to claim 6, wherein said beam member is a wide flange beam having a web portion directed longitudinally of the container and a pair of flanges directed perpendicular to the container, and where the tubular members are welded to inner edge portions of the flanges.

8. Apparatus according to claim 1, further comprising means at the ends of the container for supporting it vertically above a base surface, so that vertical space exists between the floor of the container and the base surface, and the connector means located below the container is movable through said space lengthwise of the container as the reaction frame is moved relative to the container.

9. Apparatus according to claim 8, comprising support means for the extendable-retractable power ram, said support means being supportable on the floor of said container, for movement longitudinally of the container, said support means including means for adjustably supporting the extendable-retractable power ram vertically.

10. Apparatus according to claim 9, usable for reforming a container having corrogated sidewalls comprising alternate lands and grooves, wherein said first vertical member carries a pair of spaced apart forming members sized to fit into two adjacent outside grooves, and wherein the forming end of the power ram is adapted to be moved into and fit within an inside groove between two adjacent inside lands.

11. Apparatus according to claim 10, wherein the reaction end of the ram comprises a member which spans across an inside groove and contacts two inside lands on opposite sides of said inside groove.

* * * * *